US005567919A

United States Patent [19]

Cote

[11] Patent Number: 5,567,919

[45] Date of Patent: Oct. 22, 1996

[54] GRAVIMETRIC FEEDING SYSTEM FOR BOILER FUEL AND SORBENT

[75] Inventor: Gary A. Cote, Granville, Mass.

[73] Assignee: Combustion Engineering, Inc., Windsor, Conn.

[21] Appl. No.: 172,623

[22] Filed: Dec. 22, 1993

[51] Int. Cl.[6] ..... G01G 19/52; B67D 5/08

[52] U.S. Cl. ..... 177/50; 177/119; 177/120; 177/121; 406/32; 222/57; 222/55; 222/77

[58] Field of Search ..... 177/16, 50, 119, 177/120, 121, 1; 406/31, 32; 222/55, 57, 63, 77

[56] References Cited

U.S. PATENT DOCUMENTS

| | | | |
|---|---|---|---|
| 4,038,531 | 7/1977 | Loe, Jr. | 177/25.13 X |
| 4,582,454 | 4/1986 | Brandenburg et al. | 406/32 |
| 5,044,819 | 9/1991 | Kilheffer et al. | 177/119 X |

*Primary Examiner*—Brian W. Brown
*Assistant Examiner*—Randy W. Gibson
*Attorney, Agent, or Firm*—Robert S. Smith

[57] ABSTRACT

A gravimetric control system for supplying fuel and sorbent to a circulating fluidized bed boiler which includes a loop shaped continuous belt for moving materials in a generally horizontal direction. The apparatus includes first and second belt scales disposed at spaced axial points along the belt and apparatus for continuously moving the belt sequentially past the first belt scale and then past the second belt second belt scale and then dumping all material on the belt. In addition the apparatus may include first apparatus for depositing fuel on the continuous belt before the first belt scale whereby the fuel will continue past the first belt scale and the second belt scale and will then be dumped off the belt and second apparatus for depositing sorbent material on the continuous belt intermediate the first and second belt scales so that first belt scale measures the quantity of fuel added to the continuous belt and the second belt scale measures the weight of both the fuel and the sorbent added to the belt. In addition the apparatus includes apparatus for determining the time required for fuel on the belt to move from the location of the first belt scale to the second belt scale and apparatus for comparing the weight at the first belt scale, after the lapse of the time required for fuel to pass from the first belt scale to the second belt scale to the instantaneous weight of fuel and sorbent at the second belt scale. In some forms of the apparatus the sorbent feeder apparatus includes a rotary valve and the apparatus for controlling the quantity of fuel delivered to the associated combustion process in the boiler includes a motor for driving the belt. The apparatus for controlling the motor for driving the belt may further include an input from the first belt scale.

8 Claims, 2 Drawing Sheets

GRAVIMETRIC FEEDING SYSTEM FOR BOILER FUEL AND SORBENT

TECHNICAL FIELD

The invention relates to fluidized bed steam generators. Fluidized bed combustion apparatus can burn coal efficiently at a temperatures low enough to avoid many of the problems of combustion in other modes. The term "fluidized bed" refers to the condition in which solid materials are given free flowing, fluid-like behavior. As a gas is passed upward through a bed of solid particles, the flow of gas produces forces which tend to separate the particles from one another. At low gas flows, the particles remain in contact with other lo solids and tend to resist movement. This condition is referred to as a fixed bed. As the gas flow is increased, a point is reached at which the forces on the particles are just sufficient to cause separation. The bed is then deemed to be fluidized. The gas cushion between the solids allows the particles to move freely, giving the bed a liquid-like characteristic.

Fluidized bed combustion makes possible the burning of fuels having such a high concentration of ash, sulfur, and nitrogen that they would ordinarily be deemed unsuitable. By the use of this process it is possible, at least in some cases, to avoid the need for gas scrubbers while still meeting emissions requirements. In fluidized bed combustion, the fuel is burned in a bed of hot incombustible particles suspended by an upward flow of fluidizing gas. Typically the fuel is a solid such as coal, although liquid and gaseous fuels can be readily used. The fluidizing gas is generally combustion air and the gaseous products of combustion. Where sulphur capture is not required, the fuel ash may be supplemented by inert materials such as sand or alumina to maintain the bed. In applications where sulphur capture is required, limestone is used as the sorbent and forms a portion of the bed.

Two main types of fluidized bed combustion systems are (1) bubbling fluid bed (BFB) in which the air in excess of that required to fluidize the bed passes through the bed in the form of bubbles. The bubbling fluid bed is further characterized by modest bed solids mixing rate and relatively low solids entrainment in the flue gas and (2) circulating fluid bed (CFB) which is characterized by higher velocities and finer bed particle sizes. In such systems the fluid bed surface becomes diffuse as solids entrainment increases, such that there is no longer a defined bed surface. Circulating fluid bed systems have a high rate of material circulating from the combustor to the particle recycle system and back to the combustor.

The present invention has particular application to circulating fluid bed boilers although those skilled in the art may recognize other applications. Characteristics of apparatus of this general type are further described in publication *Combustion Fossil Power,* edited by Joseph G. Singer, P.E. and published by Combustion Engineering, Inc.; a subsidiary of Asea Brown Boveri, 1000 Prospect Hill Road, Windsor, Conn. 06095, 1991. It is preferable to provide apparatus to deliver both fuel and sorbent with a gravimetric feeder as opposed to a volumetric feeder. In other words, the fuel and sorbent should be delivered by the respective weights of the fuel and the sorbent as opposed to the respective volumes. Gravimetric systems used have not been wholly satisfactory. More particularly with previous gravimetric systems fuel and sorbent were fed and were mixed either downstream of the feeders or not at all.

Conventional solid fuel feed systems have typically consisted of a pressurized belt feeder (typically gravimetric) followed by a rotary airlock valve and a fuel chute or pipe leading to the side of the lower part of the combustor. Fuel from the feeder falls by gravity through the airlock valve, into the combustor. The feeder is pressurized with cool primary air, and the head of fuel in the standpipe of the feeder inlet forms a pressure seal between bin and feeder. In alternate structures the fuel can be dropped into an airstream and injected pneumatically into the combustor. This approach helps fuel dispersion in the combustor thereby reducing the total number of openings required in the walls of the combustor.

Known systems for gravimetric feeding of both fuel and sorbent have used discreet belts for the fuel and sorbent. Known systems utilizing only a single belt for fuel and sorbent have delivered the fuel gravimetrically and the sorbent volumetrically.

OBJECTS AND SUMMARY OF THE INVENTION

It is an object of the invention to provide precise gravimetric delivery of both the fuel and the sorbent to a fluidized bed boiler.

It is another object of the invention to deliver fuel and sorbent to a boiler of this type that are more thoroughly mixed than the prior art apparatus.

It is another object of the invention to eliminate the requirement for separate feeders for the fuel and sorbent and thus to minimize the cost of the apparatus.

It is another object of the invention to provide apparatus which will closely control gravimetric feed rate for sorbent despite variations in sorbent density and air pockets in the sorbent material.

It has now been found that these and other objects of the invention may be attained in a gravimetric control system for supplying fuel and sorbent to a circulating fluidized bed boiler which includes a loop shaped continuous belt for moving materials in a generally horizontal direction. The apparatus includes first and second belt scales disposed at spaced axial points along the belt and means for continuously moving the belt sequentially past the first belt scale and then past the second belt scale and then dumping all material off the belt. In addition the apparatus may include first means for depositing fuel on the continuous belt before the first belt scale whereby the fuel will continue past the first belt scale and the second belt scale and will then be dumped off the belt and second means for depositing sorbent material on the continuous belt intermediate the first and second belt scales so that first belt scale measures the quantity of fuel added to the continuous belt and the second belt scale measures the weight of both the fuel and the sorbent added to the belt. In addition the apparatus may includes means for determining the time required for fuel on the belt to move from the location of the first belt scale to the second belt scale and means for comparing the weight at the first belt scale, after the lapse of the time required for fuel to pass from the first belt scale to the second belt scale to the instantaneous weight of fuel and sorbent at the second belt scale.

In some forms of the apparatus the sorbent feeder apparatus includes a rotary valve and the means for controlling the quantity of fuel delivered to the associated combustion process in the boiler includes a motor for driving the belt.

The means for controlling the motor for driving the belt may further include an input from the first belt scale.

In other forms of the invention the sequence of adding fuel and sorbent may be reversed.

BRIEF DESCRIPTION OF THE DRAWING

The invention will be better understood by reference to the accompanying drawing in which.

DESCRIPTION OF THE PREFERRED EMBODIMENT

Figure 1:
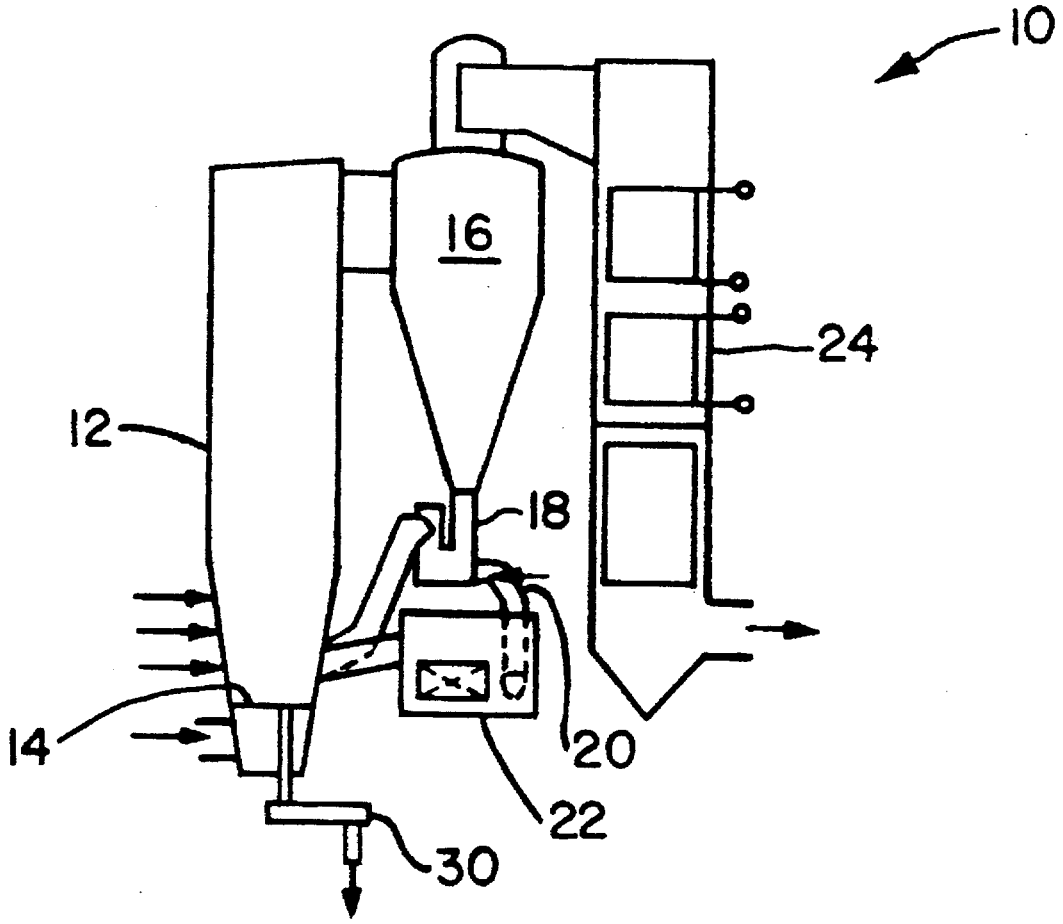
FIG. 1 is a schematic elevational view of a typical circulating fluidized bed steam generator to which the present invention has particular application.

Referring now to FIG. 1 there is shown a typical circulating fluidized bed steam generator to which the present invention has particular application. Crushed fuel and sorbent are normally fed to the lower portion of a combustor 12. Typically the fuel and sorbent material are fed to a chute (not shown) that is disposed at approximately a 60 degree angle from horizontal. Thus, the fuel and sorbent pass along the chute and into the combustor 12. Primary air is supplied to the bottom of the combustor through an air distributor 14 with secondary air fed through one or more air ports at various elevations in the lower part of the combustor. Combustion takes place throughout the combustor 12 which is filled with bed material. Flue gas and entrained solids leave the combustor 12 and enter one or more cyclones 16 where the solids are separated and fall to a seal pot 18. From the seal pot 18, the solids are recycled to the combustor 12. Optionally, some solids may be diverted through an ash control valve 20 to a fluidized bed heat exchanger 22. Flue gas leaving the cyclone 16 passes to a convective pass 24 and then to an air heater, bag house and fan (not shown). The solids in the combustor 12 are periodically allowed to pass out of the combustor 12 by draining these hot solids through an ash cooler 30.

Figure 2:
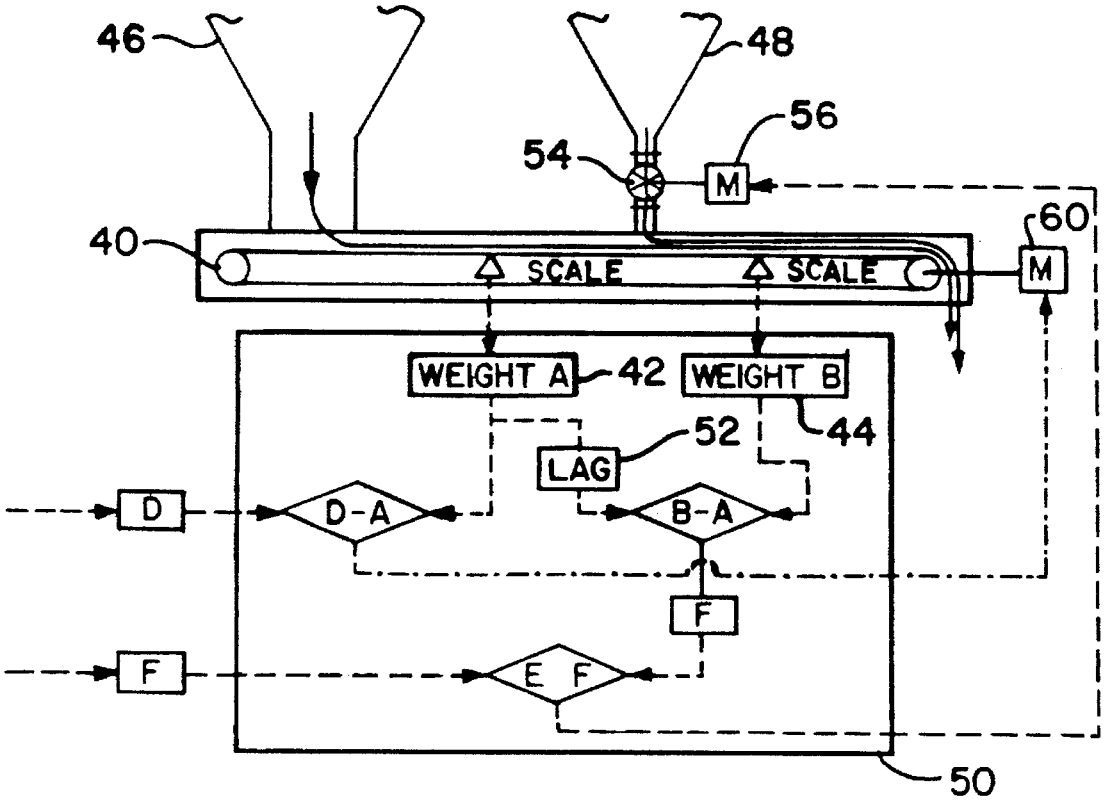
FIG. 2 is a partially schematic elevational view illustrating the present invention including a flow chart for the programmable logic controller.

As shown in FIG. 2, the preferred form of the present invention utilizes a single belt feeder 40 for both fuel and sorbent. Thus, the present invention allows the elimination of a second discrete belt feeder for the sorbent and thus saves both cost and space. It will be understood that the belt feeder 40 rotates in a clockwise direction (as viewed). Disposed at spaced intervals along the belt feeder 40 are first and second belt scales 42, 44. Disposed upstream respectively from the belt scales 42, 44 are bins 46, 48. The bins 46, 48 respectively supply fuel and sorbent to the belt feeder 40. A programmable logic controller 50 receives inputs from both the first belt scale 42 and the second belt scale 44. The fuel and sorbent will be dumped off the belt feeder 40 at the right (as shown in the drawing) hand end of the belt feeder 40.

The present invention makes a comparison of the respective weights and determines the gravimetric quantities of sorbent and fuel that are on the belt at the point where the belt scale 44 is disposed. This is possible because the belt scales 42, 44 are respectively upstream and downstream of the point where the bin 48 supplies sorbent to the belt feeder 40. More particularly the present invention includes a programmable logic controller 50 to which is supplied an input (the weight) from at belt scale 42 and another input (the weight) from the belt scale 44. The programmable logic controller 50 provides a lag 52 corresponding to the time required for the fuel to pass from the location of the belt scale 42 to the belt scale 44 and thus compares the weight of sorbent at the belt scale 44 to the weight of the sorbent and fuel at the belt scale 44. The difference is the weight of the sorbent added by the bin 48. The programmable logic controller 50 compares the desired weight to the actual weight and then adjusts the speed of the motor 56 that drives the rotary valve 54. Those skilled in the art will recognize that the weight of material added per unit of time is the rate at which material is added to the feed belt 40.

The supply of sorbent to the belt feeder 40 from the bin 48 is controlled by a rotary valve 54. The rotary valve 54 is controlled by a motor 56 which is in turn controlled by the programmable logic controller 50. The control of the motor 56 driving the rotary valve 54 determines the actual amount of sorbent delivered to the belt feeder 40. The programmable logic controller 50 compares the actual feed rate to the intended or desired gravimetric feed rate.

It will be understood that a motor 60 is provided to drive the continuous belt feeder 40 and that this motor 60 is driven at a speed and/or periods of time corresponding to the desired rate of delivery of fuel to the combustion process. More specifically, the belt scale 42 sends a signal to the motor 60 and thus controls the motor 60. The signal from the programmable logic controller 50 to the motor 60 is a function of the weight of the fuel added to the belt feeder 40 per unit of time and a desired weight of fuel added to the belt feeder per unit of time. It will be further seen by those skilled in the art that the control of the quantity of fuel is governed by the rate of which the fuel exits the bin 46 as well as the speed of the belt feeder 40 as determined by the motor 60. It will also be seen that the relative rates of sorbent and fuel are controlled by the motor 56 controlling the valve 54 and that this control is achieved by the programmable logic controller 50.

At least some prior art structures have used a rotary valve to position the sorbent on the belt feeder 40. Such structures were not satisfactory because the rotary valve without the controls described in the preferred embodiment of the present invention merely provides a volumetric control of the amount of sorbent material added to the belt feeder 40. Volumetric approximation is not at all as satisfactory as the gravimetric feed rate control that is possible with the apparatus of the present invention. More particularly, a volumetric control of sorbent can only approximate the weight of sorbent that is ideally desired because of variations in density due to the nature of the material as well as the presence or absence of air pockets in the material. The present invention provides for variations in sorbent density as well as pockets in the material that cannot have been readily accounted for with a volumetric control apparatus. In the present invention the dual scales 42, 44 enable precise control of the rotary valve 54 and thus a true gravimetric sorbent feed rate control with only a single belt feeder.

In some forms of the invention the programmable logic controller 50 may be a dedicated programmable logic controller. The programmable logic controller 50 is common commercial commodity and typical dedicated programmable logic controllers are made by General Electric and Allen Bradley. In other forms of the invention the programmable logic controller 50 may part of the distributed control system of the plant in which the fluidized bed steam generator is located.

The invention has been described with reference to its illustrated preferred embodiment. Persons skilled in the art of such devices may upon disclosure to the teachings herein, conceive other variations. For example, although the invention has been described in terms of a bin first adding fuel to a belt feeder and then adding sorbent to the belt feeder, those skilled in the art will recognize that the order may be reversed without departing from the spirit of the present invention. Such variations are deemed to be encompassed by the disclosure, the invention being delimited only by the following claims.

Having thus described my invention, I claim:

1. Apparatus which comprises:

a circulating fluidized bed boiler;

a gravimetric control and supply system which includes a loop shaped continuous belt for moving materials in a generally horizontal direction to supply fuel and sorbent to the circulating fluidized bed boiler;

first and second belt scales disposed at spaced axial points along said belt;

means for continuously moving said belt sequentially past said first belt scale and then past said second belt scale and then dumping all material from said belt;

first means for depositing fuel on said continuous belt before said first belt scale whereby the fuel will continue past said first belt scale and said second belt scale and will then be dumped off said belt;

second means for depositing sorbent material on said continuous belt intermediate said first and second belt scales so that first belt scale measures the quantity of fuel added to said continuous belt and said second belt scale measures the weight of both said fuel and said sorbent added to said belt;

means for determining the time required for fuel on said belt to move from the location of said first belt scale to said second belt scale and means for comparing the weight at said first belt scale, after the lapse of the time required for fuel to pass from said first belt scale to said second belt scale to the instantaneous weight of fuel and sorbent at said second belt scale.

2. The apparatus as described in claim 1 wherein said second means for depositing comprises:

a rotary valve.

3. The apparatus as described in claim 2 wherein:

said means for controlling the quantity of fuel delivered to the associated combustion process in the boiler includes a motor for driving the belt.

4. The apparatus as described in claim 3 wherein:

the apparatus further includes means for controlling said motor for driving said belt includes an input from said first belt scale.

5. Apparatus which comprises:

a circulating fluidized bed boiler;

a gravimetric control system for supplying that includes a loop shaped continuous belt for moving fuel material and sorbent materials in a generally horizontal direction to said circulating fluidized bed boiler;

first and second belt scales disposed at spaced axial points along said belt;

means for continuously moving said belt sequentially past said first belt scale and then past said second belt scale and then dumping all material off said belt;

first means for depositing a first material on said continuous belt before said first belt scale whereby the first material will continue past said first belt scale and said second belt scale and will then be dumped off said belt;

second means for depositing a second material on said continuous belt intermediate said first and second belt scales so that first belt scale measures the quantity of first material added to said continuous belt and said second belt scale measures the weight of both said first and second material added to said belt;

means for determining the time required for the first material on said belt to move from the location of said first belt scale to said second belt scale and means for comparing the weight at said first belt scale, after the lapse of the time required for fuel to pass from said first belt scale to said second belt scale, to the instantaneous weight of the first and second material at said second belt scale.

6. The apparatus as described in claim 5 wherein second means for depositing comprises:

a rotary valve.

7. The apparatus as described in claim 6 wherein:

said means for controlling the quantity of first material delivered to the associated combustion process in the boiler includes a motor for driving the belt.

8. The apparatus as described in claim 7 wherein:

the apparatus further includes means for controlling said motor for driving said belt includes an input from said first belt scale.

* * * * *